US011927017B2

(12) United States Patent
Whitridge, Jr. et al.

(10) Patent No.: US 11,927,017 B2
(45) Date of Patent: Mar. 12, 2024

(54) ROOFING SYSTEM AND METHOD

(71) Applicant: Millennium Slate, LLC, Middle Granville, NY (US)

(72) Inventors: Frederick W. Whitridge, Jr., Stanfordville, NY (US); Philip C. Prehoda, Middle Granville, NY (US); Thomas J. Collard, West Pawlet, VT (US); Charles Ward, West Rupert, VT (US)

(73) Assignee: Millennuim Slate, LLC, Middle Granville, NY (US)

( * ) Notice: Subject to any disclaimer, the term of this patent is extended or adjusted under 35 U.S.C. 154(b) by 234 days.

(21) Appl. No.: 17/708,191

(22) Filed: Mar. 30, 2022

(65) Prior Publication Data

US 2022/0251847 A1 Aug. 11, 2022

Related U.S. Application Data

(63) Continuation-in-part of application No. 16/694,436, filed on Nov. 25, 2019, now Pat. No. 11,578,494, (Continued)

(51) Int. Cl.

| | |
|---|---|
| ***E04D 13/04*** | (2006.01) |
| ***E04D 1/28*** | (2006.01) |
| ***E04D 1/34*** | (2006.01) |

(52) U.S. Cl.

CPC ..... *E04D 13/0481* (2013.01); *E04D 1/28* (2013.01); *E04D 1/34* (2013.01); *E04D 2001/3408* (2013.01)

(58) Field of Classification Search

CPC ..... E04D 13/0481; E04D 1/34; E04D 2001/3408; E04D 1/2918; E04D 1/28

See application file for complete search history.

(56) References Cited

U.S. PATENT DOCUMENTS

| | | | |
|---|---|---|---|
| 623,988 | A | 5/1899 | Contant |
| 676,579 | A | 6/1901 | Esselen |

(Continued)

FOREIGN PATENT DOCUMENTS

| | | | |
|---|---|---|---|
| DE | 4100902 | A1 | 8/1991 |
| DE | 29819035 | U1 | 2/1999 |

(Continued)

*Primary Examiner* — Adriana Figueroa

(74) *Attorney, Agent, or Firm* — Bulkley, Richardson and Gelinas, LLP; Mary R. Bonzagni, Esq.

(57) ABSTRACT

A roofing system and method, which includes elongate rain diverting devices for directing rainwater and snowmelt away from an underlying sheet material and roof deck, is provided. The system includes roofing tiles having strips of hook and loop fasteners (H&L strips) adhered to both faces. The rain diverting devices have an H&L strip adhered along a lower edge of both faces. As each new row of tiles is installed on the roof deck, the device is applied over an upper portion of the tiles, extending over and onto the sheet material above the tiles, and across the roof deck. As additional rows of tiles are installed, each device is releasably attached to underlying and overlying tiles by way of the H&L strips adhered to both the tiles and the device. The devices also allow for single lap tiling (less weight on roof deck) and for use of shorter tiles (saving material cost).

18 Claims, 12 Drawing Sheets

Related U.S. Application Data which is a continuation-in-part of application No. 16/000,347, filed on Jun. 5, 2018, now Pat. No. 10,829,937.

(60) Provisional application No. 62/515,162, filed on Jun. 5, 2017.

(56) References Cited

U.S. PATENT DOCUMENTS

| | | | | |
|---|---|---|---|---|
| 1,107,568 | A | 8/1914 | Bamberger et al. | |
| 1,462,212 | A | 7/1923 | Percsenyi | |
| 1,467,510 | A | 9/1923 | Smith, Jr. | |
| 1,590,744 | A | 6/1926 | Hatch | |
| 1,597,135 | A | 8/1926 | Wittenberg | |
| 1,619,600 | A | 3/1927 | Cumfer | |
| 1,661,562 | A | 3/1928 | Conway | |
| 1,963,583 | A | 6/1934 | Jenkins | |
| 2,149,818 | A | 3/1939 | North | |
| 2,210,209 | A | 8/1940 | Kirschbraun | |
| 2,250,918 | A | 7/1941 | Roos | |
| 2,292,984 | A | 8/1942 | Alvarez, Jr. | |
| 2,300,488 | A | 11/1942 | Cuno | |
| 2,535,620 | A | 12/1950 | Alvarez, Jr. | |
| 3,418,777 | A | 12/1968 | Gillis | |
| 3,703,062 | A | 11/1972 | McKinney | |
| 3,913,294 | A | 10/1975 | Freiborg | |
| 3,945,166 | A | 3/1976 | Hosoda et al. | |
| 3,999,348 | A | 12/1976 | Hicks | |
| 4,426,823 | A | 1/1984 | Kobe | |
| 4,489,115 | A | 12/1984 | Layman et al. | |
| 4,499,700 | A | 2/1985 | Gustafsson | |
| 4,649,069 | A | 3/1987 | Tone | |
| 4,668,315 | A | 5/1987 | Brady et al. | |
| 4,744,189 | A | 5/1988 | Wilson | |
| 4,755,401 | A | 7/1988 | Friedrich et al. | |
| 4,974,384 | A | 12/1990 | Pacione | |
| 5,060,443 | A | 10/1991 | Pacione | |
| 5,144,786 | A | 9/1992 | Pacione | |
| 5,457,924 | A | 10/1995 | Fujii et al. | |
| 5,505,788 | A | 4/1996 | Dinwoodie | |
| 5,617,690 | A | 4/1997 | Gibbs | |
| 5,642,596 | A | 7/1997 | Waddington | |
| 5,723,195 | A | 3/1998 | Pacione | |
| 5,737,881 | A | 4/1998 | Stocksieker | |
| 5,794,396 | A | 8/1998 | Gibbs | |
| 5,916,103 | A | 6/1999 | Roberts | |
| 5,950,319 | A | 9/1999 | Harris | |
| 5,950,387 | A | 9/1999 | Stahl et al. | |
| 6,083,596 | A | 7/2000 | Pacione | |
| 6,148,578 | A | 11/2000 | Nowacek et al. | |
| 6,298,624 | B1 * | 10/2001 | Pacione | E04F 13/0882 52/391 |
| 6,336,304 | B1 | 1/2002 | Mimura et al. | |
| 6,395,362 | B1 | 5/2002 | Pacione | |
| 6,516,572 | B1 | 2/2003 | Nowacek et al. | |
| 6,534,703 | B2 | 3/2003 | Dinwoodie | |
| 7,045,197 | B2 | 5/2006 | Harris | |
| 7,219,476 | B2 | 5/2007 | Akins et al. | |
| 7,578,108 | B2 | 8/2009 | Swanson | |
| 8,256,185 | B2 | 9/2012 | Kirkey | |
| 8,276,329 | B2 | 10/2012 | Lenox | |
| 8,297,020 | B1 | 10/2012 | Swanson | |
| 9,234,352 | B2 | 1/2016 | Olson et al. | |
| 9,788,674 | B2 | 10/2017 | Pacione et al. | |
| 10,233,646 | B2 | 3/2019 | McGraw et al. | |
| 10,358,824 | B2 | 7/2019 | Aschenbeck et al. | |
| 2001/0042350 | A1 * | 11/2001 | Pacione | E04F 13/0882 52/578 |
| 2002/0136846 | A1 | 9/2002 | Prevost | |
| 2003/0070391 | A1 | 4/2003 | Tachauer et al. | |
| 2004/0000334 | A1 | 1/2004 | Ressler | |
| 2004/0055240 | A1 | 3/2004 | Kiik et al. | |
| 2004/0187420 | A1 | 9/2004 | Bernardi et al. | |
| 2005/0252141 | A1 | 11/2005 | Kerkar et al. | |
| 2005/0281963 | A1 | 12/2005 | Cook | |
| 2006/0039754 | A1 | 2/2006 | Linville | |
| 2006/0154017 | A1 | 7/2006 | Shepard et al. | |
| 2006/0191218 | A1 | 8/2006 | Pacione | |
| 2007/0266660 | A1 | 11/2007 | Davies et al. | |
| 2009/0064618 | A1 | 3/2009 | Ben-Daat et al. | |
| 2009/0159118 | A1 | 6/2009 | Kalkanoglu et al. | |
| 2009/0220720 | A1 | 9/2009 | Mohseen et al. | |
| 2009/0255201 | A1 | 10/2009 | Kraus et al. | |
| 2010/0059104 | A1 * | 3/2010 | Geary | E04D 11/00 136/251 |
| 2012/0266559 | A1 | 10/2012 | Thies, III | |
| 2013/0000237 | A1 | 1/2013 | Kraus et al. | |
| 2013/0001820 | A1 | 1/2013 | Kraus et al. | |
| 2013/0008113 | A1 | 1/2013 | Kraus et al. | |
| 2013/0025225 | A1 | 1/2013 | Vermillion et al. | |
| 2013/0067852 | A1 | 3/2013 | Kalkanoglu et al. | |
| 2013/0160388 | A1 | 6/2013 | Williams et al. | |
| 2013/0318895 | A1 * | 12/2013 | Geary | F24S 25/61 52/173.3 |
| 2015/0089895 | A1 | 4/2015 | Leitch | |
| 2016/0340903 | A1 | 11/2016 | Folkersen et al. | |
| 2017/0145271 | A1 | 5/2017 | Loftus et al. | |
| 2017/0306632 | A1 | 10/2017 | Wood et al. | |
| 2018/0347195 | A1 | 12/2018 | Whitridge, Jr. et al. | |

FOREIGN PATENT DOCUMENTS

| | | | |
|---|---|---|---|
| DE | 19926344 | C1 | 3/2001 |
| DE | 102013006616 | A1 | 10/2014 |
| EP | 1795654 | A2 | 6/2007 |
| EP | 2508688 | B1 | 10/2012 |
| EP | 2669446 | B1 | 12/2013 |
| FR | 2483493 | A | 12/1981 |
| GB | 2145131 | A | 3/1985 |
| GB | 2341618 | A | 3/2000 |
| JP | 2003090103 | A | 3/2003 |
| JP | 2004019398 | A | 1/2004 |
| KR | 1944212 | B1 | 1/2019 |
| NL | 2006964 | | 12/2012 |
| WO | WO 8102437 | | 9/1981 |
| WO | WO 9836139 | | 8/1998 |
| WO | WO 1998036139 | A1 | 8/1998 |
| WO | WO 2008063660 | A2 | 5/2008 |
| WO | WO 2010034730 | A2 | 4/2010 |

* cited by examiner

ROOFING SYSTEM AND METHOD

CROSS-REFERENCE TO RELATED APPLICATIONS

This application is a continuation-in-part application of U.S. patent application Ser. No. 16/694,436, filed Nov. 25, 2019, which is a continuation-in-part application of U.S. patent application Ser. No. 16/000,347 filed Jun. 5, 2018, now U.S. Pat. No. 10,829,937, which claims the benefit of priority of U.S. Provisional Patent Application Ser. No. 62/515,162, filed Jun. 5, 2017, the contents of each application herein incorporated by reference.

BACKGROUND OF THE INVENTION

The present invention relates to roofing and more particularly to a lighter, more cost-effective roofing system and method of roofing, which utilizes an elongate rain diverting device for directing rainwater and snowmelt away from an underlying sheet material and/or roof deck.

As is well known to those skilled in the art, types of roofing tiles include, but are not limited to, asphalt, wood, cement, fiber-cement mixtures, concrete, clay or ceramic material, natural stone such as slate, slate substitutes, rubber slate, other hardwearing materials and metal.

Existing systems for affixing, for example, slate roofing tiles to buildings are expensive in terms of both materials and labor. The current systems include nailing or screwing slate to the roof, using cumbersome hook and rail systems, or using a clamping type track system. Each of these traditional systems are expensive in terms of material and require a considerable amount of labor.

Additionally, nailed and screwed applications can be "over nailed" or "under nailed" referring to the height of the head of the fastener in relation to the face of the slate. Under nailed slate, with heads that protrude above the face of the slate, may break the pieces of slate which overlap them. Over nailed slate, with a head of the nail driven down into the countersink area on the slate, risks breakage. Hook and rail systems can be troublesome if the nailing eye of the hook is missed. Hooks can typically only be applied in a rigidly preset pattern and do not adapt easily to varying field conditions or design changes which may become desirable during installations. Tracked and clamping systems are also very rigid in terms of layout and don't allow variations in the natural material.

Further, the art teaches the arrangement of such natural stone roofing tiles in either a double or triple overlap to reduce or avoid rainwater and snowmelt entering into the separation between adjacent tiles and onto an underlying substrate. As used herein, the term "double overlap" means that the upper tile extends over the tiles two courses or rows down on the roof deck, while the term "triple overlap" means that the upper tile extends over the tiles three rows down.

As will be readily appreciated, double and triple overlap of natural stone roofing tiles increases the deadload on a roof or supporting structure. It also requires the use of tiles of a certain minimum length, which increases material costs.

As can be seen, there is a need for an improved system and method of roofing, which addresses the above-noted drawbacks.

SUMMARY OF THE INVENTION

The present invention overcomes these drawbacks by providing a lighter, more cost-effective, and less laborintensive roofing system, which includes an elongate rain diverting device for directing rainwater and snowmelt away from an underlying sheet material and roof deck. In an exemplary embodiment, the system of roofing comprises:

- a sheet material for adhering to a roof deck, which has an upper surface and a lower surface, the upper surface including a hook and loop fastener;
- a plurality of roofing tiles each having a width and a front and back face;
- a plurality of strips having a width, with hook and loop fasteners on a surface thereof, which are adhered to and extend across at least a portion of the width of each tile on (i) an upper portion of the front face of each tile at a distance from an upper edge thereof (strip A), and (ii) on an upper and on a lower portion of the back face near upper and lower edges thereof (strips B and C, respectively);
- a plurality of elongate rain diverting devices, each having a front and a back face with a corresponding lower edge, wherein a strip of hook and loop fasteners, having a width that preferably approximates the width of the strips adhered to each tile, is adhered along the lower edge of both the front and back faces of each elongate device (strip I and strip II, respectively),
- wherein once roofing tiles are arranged in a course or row on the roof deck and releasably attached to the sheet material by way of strip B, an elongate rain diverting device is positioned on the upper portion of the front face of each tile, extending above each tile and onto the sheet material, and across the roof deck, and is releasably attached to each tile by way of strip II of the device being releasably attached to strip A of each tile,
- wherein as each subsequent row of tiles is arranged on the roof deck, partially overlapping an underlying row with a partially overlying elongate device, each tile in the subsequent row is releasably attached to the elongate device by way of strip C of the tile being releasably attached to strip I of the device and is releasably attached to the sheet material by way of strip B of the tile being releasably attached to the hook and loop fastener on the upper surface of the sheet material.

The elongate rain diverting device extends across the width of the roof deck, over an upper portion of the tiles in each row, and over and onto the sheet material above the tiles, thus extending under a subsequently installed, overlying row of tiles. The elongate rain diverting device may be lapped at the end of rolls to span the width of the roof deck. The rain diverting device extends onto the sheet material above the tiles ending below strip B of overlying tiles, thereby allowing strip B of the overlying tiles to releasably attach to the sheet material during installation. The use of the rain diverting device serves to prevent water or moisture from migrating beneath the tiles. Any moisture that may migrate through a vertical seam of adjoining tiles, or via a broken or missing tile, would be shed down the rain diverting device onto a lower course or row of tiles.

An advantage of this embodiment is that the strip of hook and loop fastener on each roofing tile that is covered by the rain diverting device is covered by another layer of hook and loop fastener, so that the strength of the bond between each tile and an overlying tile(s) is not reduced. This embodiment also "locks" adjoining tiles on their front face, via interlocking with the rain diverting device, as well as on the rear face.

The term "tile" or "roofing tile" as used in the present specification refers to slabs or shingles made from asphalt (i.e., fiberglass sandwiched between asphalt and ceramic granules), wood, cement, fiber-cement mixtures, concrete, clay or ceramic material, natural stone such as slate, slate substitutes, rubber slate, and other hardwearing materials and metal (e.g., steel, aluminum, copper, alloy strips) including stone-coated steel.

In another aspect of the present invention, a method of installing tiles on a roof is provided, which comprises:

providing a sheet material having an upper surface and a lower surface, the upper surface including a hook and loop fastener;

securing the lower surface of the sheet material to a roof deck;

providing a plurality of roofing tiles, each tile having a width and a front and back face, wherein strips of hook and loop fasteners are adhered to and extend across at least a portion of the width of each tile on (i) an upper portion of the front face at a distance from an upper edge thereof (strip A), and (ii) on an upper and on a lower portion of the back face near upper and lower edges thereof (strips B and C, respectively);

providing a plurality of elongate rain diverting devices, each having a front face and a back face with a lower edge, wherein a strip of hook and loop fasteners, preferably having a width which approximates the width of the strips adhered to each tile, is adhered along the lower edge of both the front and back face of the elongate device (strips I and II, respectively), wherein, once roofing tiles are arranged in a course or row on the roof deck and adhered to the sheet material by way of strip B of each tile, positioning an elongate rain diverting device on the upper portion of the front face of each tile, extending above each tile onto the sheet material, adhering the device to each tile by way of strip II of the device being releasably attached to strip A of each tile, wherein as each subsequent row of tiles is arranged on the roof deck, partially overlapping an underlying row with a partially overlying elongate device, releasably attaching each tile to the underlying elongate device by way of strip C of each tile being releasably attached to strip I of the device, releasably attaching each tile to the sheet material by way of strip B of each tile being releasably attached to the hook and loop fastener on the upper surface of the sheet material, and positioning another elongate device on the upper portion of the front face of each tile in the subsequent row, extending above each tile onto the sheet material, and across the roof deck, and adhering the device to each tile by way of strip II of the device being releasably attached to strip A of each tile.

The present invention further provides a method of using a plurality of elongate rain diverting devices to direct rainwater and snowmelt away from an underlying sheet material on a roof deck, each device having strips of hook and loop fasteners adhered to lower edges of opposing faces, wherein for each row of tiles installed on the roof deck, the method comprises: positioning and releasably attaching the elongate rain diverting device to upper portions of exposed faces of the tiles in the row prior to installation of a subsequent, partially overlying row, the device extending above each tile onto the sheet material and across the roof deck, wherein each device serves to divert rainwater and snowmelt away from separations between adjacent tiles and the underlying sheet material.

These and other features, aspects and advantages of the present invention will become better understood with reference to the following drawings, description and claims.

DETAILED DESCRIPTION OF THE INVENTION

Figure 1:
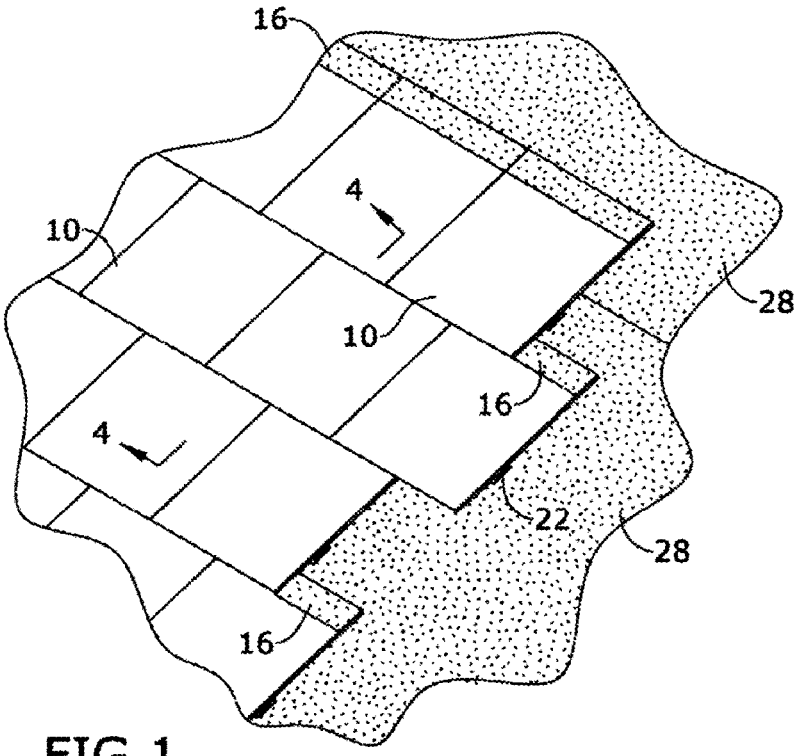
FIG. 1 is a perspective view of a partial installation of an embodiment of the present invention.
Figure 2:
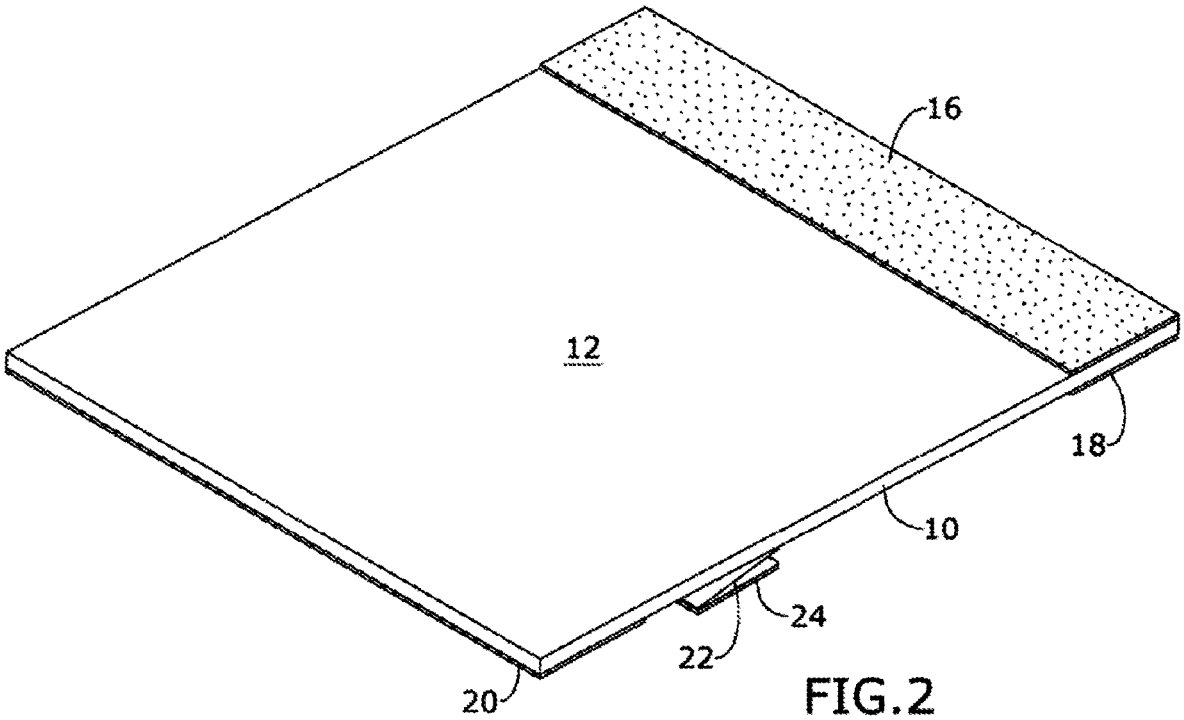
FIG. 2 is a top perspective view of a tile of an embodiment of the present invention.
Figure 3:
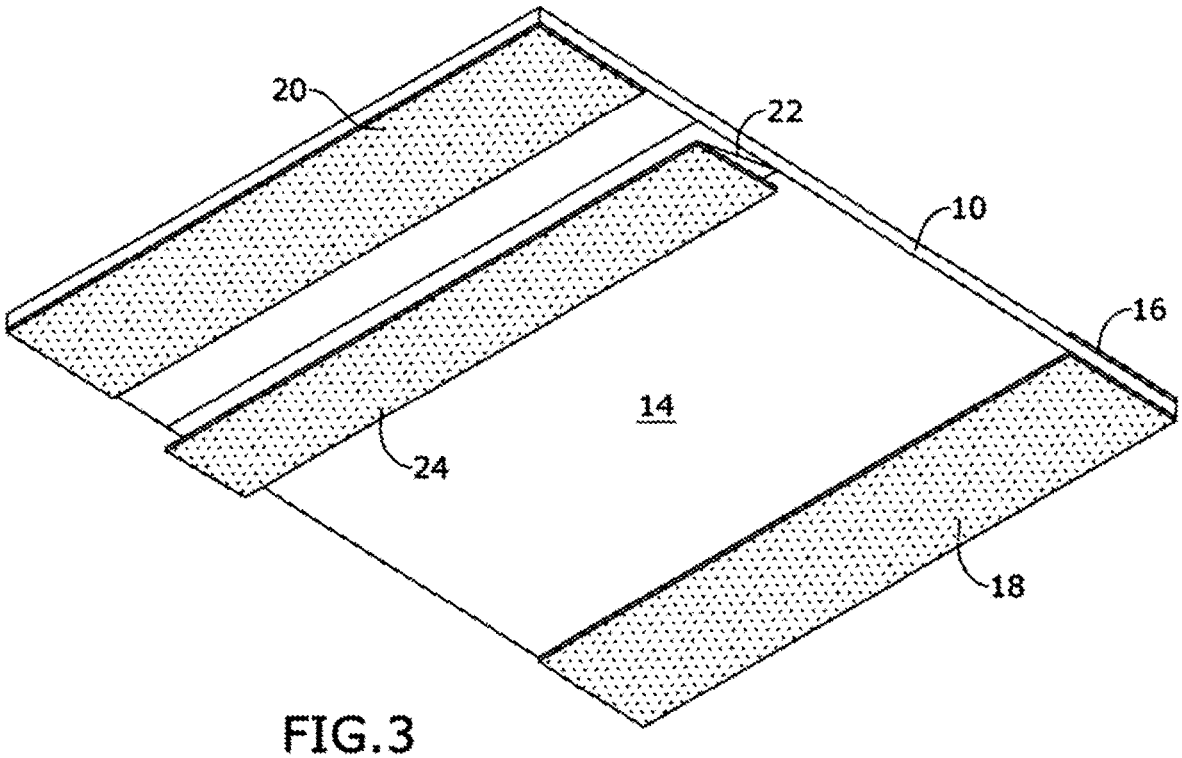
FIG. 3 is a bottom perspective view of a tile of an embodiment of the present invention.
Figure 4:
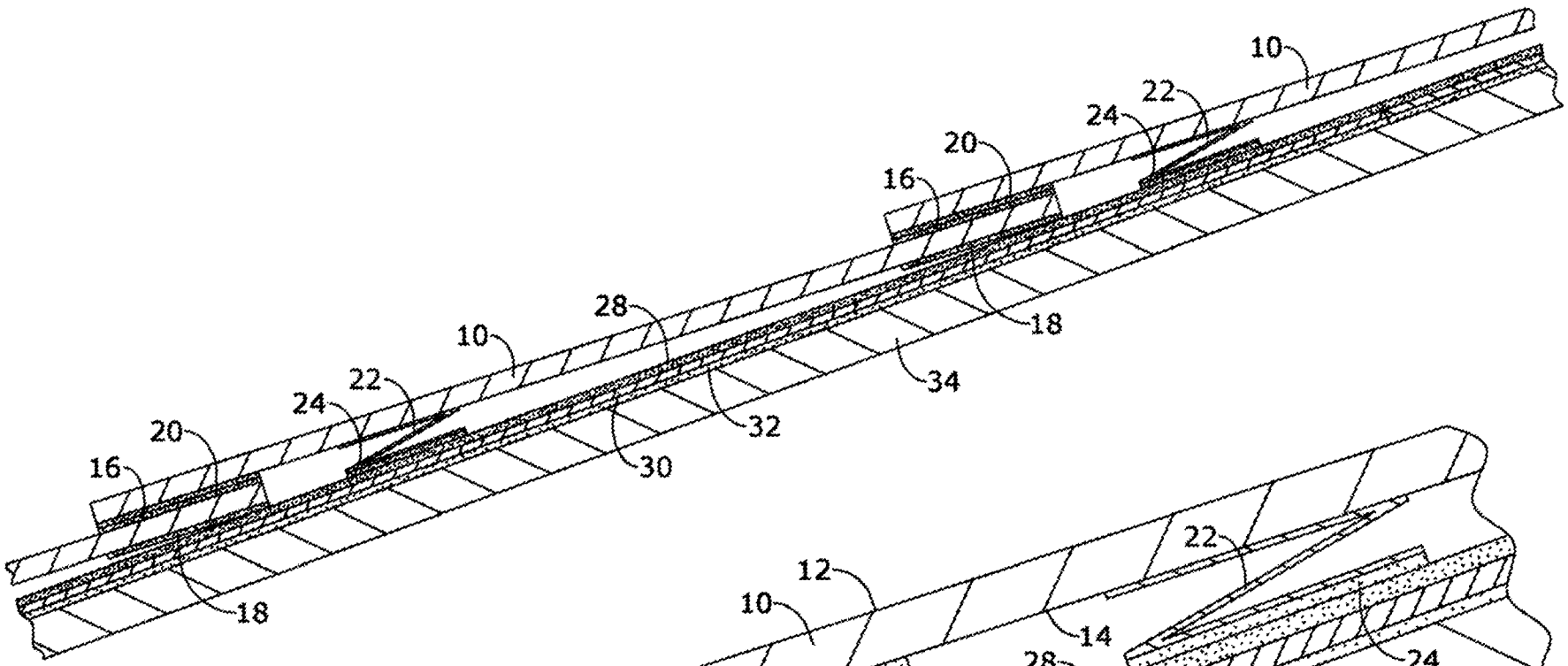
FIG. 4 is a section view of the present invention taken along line 4-4 in FIG. 1.
Figure 5:
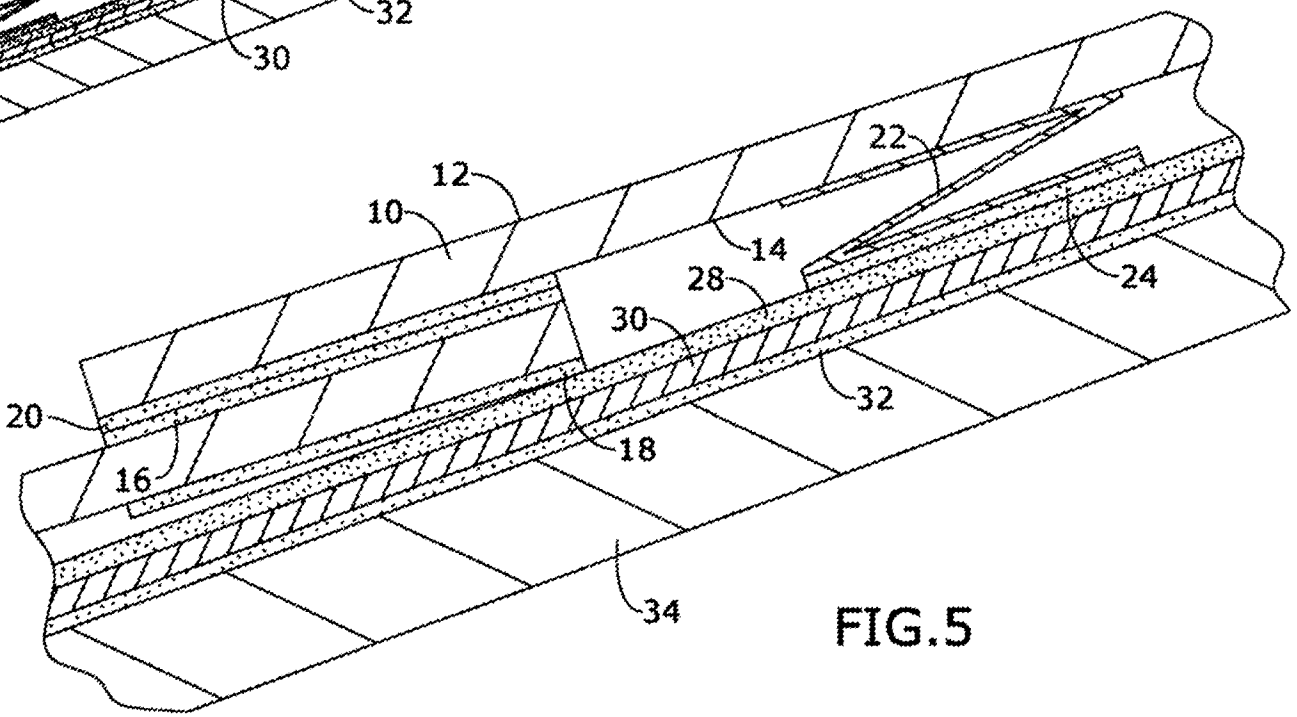
FIG. 5 is a detail section view of an embodiment of the present invention.
Figure 6:
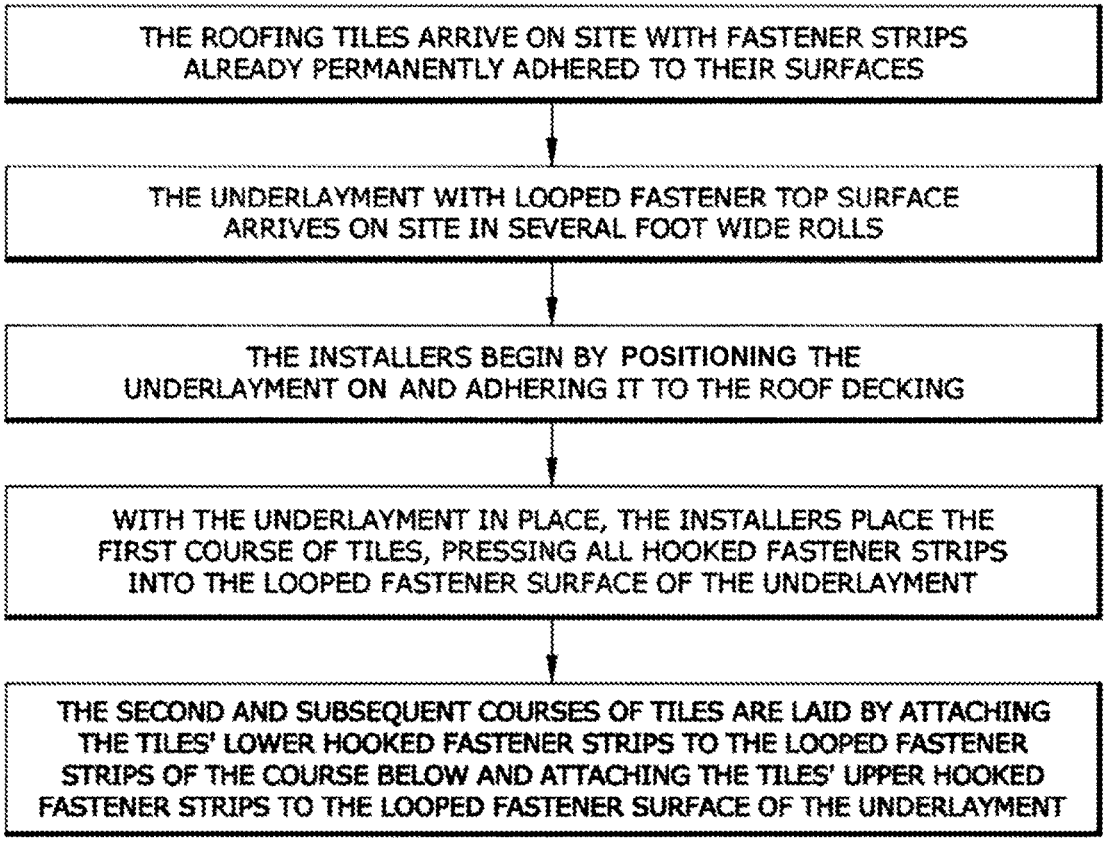
FIG. 6 is a flow chart of a method of installing tiles of an embodiment of the present invention.
Figure 7:
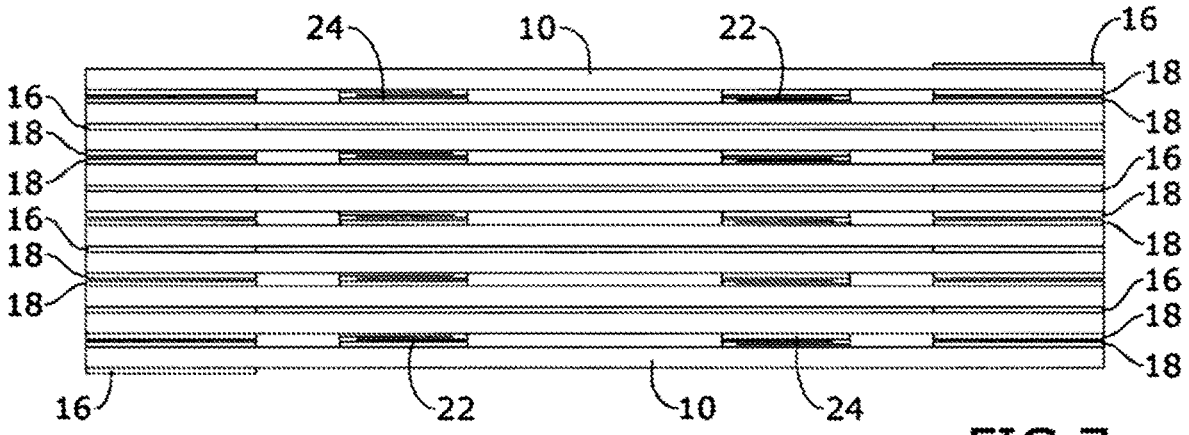
FIG. 7 is a side view of tiles in accordance with the present invention stacked for storage and shipping.

The following detailed description is of exemplary embodiments of the invention. The description is not to be taken in a limiting sense but is made merely for the purpose of illustrating the general principles of the invention, since the scope of the invention is best defined by the appended claims.

The present invention includes a system and method of roofing. A sheet material is positioned on and adhered to a bare roof or roof deck. This sheet material, which has an upper surface that includes a hook and loop fastener, is both a moisture barrier and serves as one half of the mechanical fastening hook and loop system. Hook and loop fasteners (e.g., in the form of strips, tapes or patches) are adhered to both a front face and a back face of individual roofing tiles. During installation, a row of tiles is arranged on the roof deck. Each tile is applied next to a previously installed tile and pressed onto the underlying sheet material on the roof deck (both with complimentary hook and loop fasteners). The tiles are applied in succession to complete the row, or course, on the roof deck. An elongate rain diverting device having strips of complimentary hook and loop fasteners adhered along a lower edge of opposing faces of the device is applied over the upper portion (e.g., upper third portion) of the entire row of tiles and pressed down upon the strip of hook and loop fasteners on the front face of each tile so that approximately one-half of the width of the device extends beyond the upper edge of each tile and onto or against the sheet material. A subsequent row of tiles is then arranged preferably offset from the tiles in the previous row, totally overlapping the rain diverting device and partially overlapping the tiles in the previous row, an upper portion of each tile being pressed onto the underlying sheet material. An elongate rain diverting device is then applied over the upper portion of the entire subsequent row of tiles and pressed down upon the hook and loop fasteners on the front face of each tile as noted above for the previous row. This process is then repeated until the roof has been completely tiled.

In an exemplary embodiment, a starter row is assembled on the roof deck, at the onset of the tiling process, which is prepared by:

(a) applying a beveled strip or cant strip having one or more strips of hook and loop fasteners on opposing faces thereof (e.g., hook on the front and loop on the back) on the sheet material, which serves to change the pitch of the roof slope, the beveled strip being releasably attached to the sheet material by way of the strip(s) of hook and loop fasteners on the back side of the beveled strip being releasably attached to the hook and loop fastener on the upper surface of the sheet material. A cant strip typically has a maximum thickness equal to the slate being applied. Its purpose is to slant up the first course as each other course will be slanted;

(b) applying flashing or drip edge having one or more strips of hook and loop fastener on opposing faces thereof (e.g., hook on the front and loop on the back) completely over the cant strip, extending beyond the cant strip and onto the fascia, thereby serving to lead rain and moisture away from the fascia, the flashing being releasably attached to the beveled strip by way of the strips of hook and loop fastener on the back face of the flashing being releasably attached to the strips of hook and loop fastener on the front face of the beveled strip;

(c) applying the elongate rain diverting device over the flashing, with strip II of the elongate device releasably attaching to a strip of hook and loop fastener on the front face of the flashing;

(d) applying starter tiles having strips of hook and loop fastener on upper and lower portions of opposing faces thereof in a row over the elongate rain diverting device, the strips on the lower portion of the back face of each tile releasably attaching to strip I of the underlying rain diverting device, while the strips on the upper portion of the back face of each tile releasably attaching to the hook and loop fastener on the upper surface of the sheet material;

(e) applying an elongate rain diverting device over the upper portion of the starter tiles, with strip II of the elongate device releasably attaching to a strip of hook and loop fastener on the front face of each starter tile; and then (f) applying a first row of tiles onto the starter tiles, with each tile releasably attached to the underlying rain diverter by way of strip B of the tile being attached to strip I of the device, and to the underlying starter tile by way of strip C of the tile being releasably attached to the strip on the lower portion of the front face of each starter tile.

In a preferred embodiment, the starter tiles are beveled, chamfered edge starter tiles, with the beveled, chamfered edge facing the roof deck. The tiles are placed side by side forming a knife edge between adjacent tiles where the beveled, chamfered edges meet, thus serving to block moisture from entering into any separation between tiles.

Advantageously, the detachability of this hook and loop method allows changes to be easily made while installation is underway.

The hook and loop system and method of the present invention removes the variable quality and expensive field labor of traditional installation methods. Individual tiles may be easily pressed together in patterns which may be dictated by field conditions. Beneficially, changing an individual tile because of improper color or placement is easily solved by the detachable and replaceable nature of the hook and loop fastening system and the rain diverting devices.

As noted above, a further advantage of the above-described exemplary embodiment is that the hook and loop fastener on the roofing tiles that is covered by the rain diverting device is covered by another layer of hook and loop fastener, so that the strength of the bond between each tile and adjacent and overlying tiles is not reduced. The subject invention allows for single instead of double or triple overlap, which allows for the use of shorter tiles, which saves material costs. It also reduces the overall weight of the entire roofing system, greatly reducing the demand on the supporting structure.

The term "hook and loop fastener" as used in the present specification refers to either portion of a fastener comprising two portions, namely a hook portion (e.g., J hook, palm tree hook, mushroom hook) and a portion complementary to the hook portion for example a loop portion such that the two portions are releasably interconnected when brought into contact with each other. Such fasteners are sold, for example, under the trade designations VELCRO and 3M DUAL-LOCK. The use of the term also includes those types of fasteners known as hook and hook fasteners in which there are opposing portions of interlockable hooks. The term also includes any other touch and grip type fastener of the type in which temporary interconnection is achieved when the two components thereof are brought into contact with each other.

In one exemplary embodiment, the hook and loop fastener is prepared from low surface energy resinous or plastic materials. In one such embodiment, the hook fasteners are polypropylene hook fasteners and the complimentary fasteners are nylon loop fasteners.

The hook and loop fastener has a preferred combined thickness of less than or equal to about 3 millimeters (mm), more preferably, from about 1 to about 3 mm, and most preferably, from about 1.5 to about 2.5 mm.

The degree of adhesion achieved by the hook and loop fastener is dependent upon such variables as the density of the hook and loop components, the height of the loops, the length of the hook stems and the weight of the roofing tile.

The hook and loop fasteners are adhered to and preferably cover less than or equal to about 35% of the back face and less than or equal to about 20% of the front face of each tile. In a more preferred embodiment, the hook and loop fasteners are adhered to and cover from about 20 to about 35% of the back face and from about 10 to about 20% of the front face of each tile. The hook and loop fasteners may be applied in strip, band or patch forms, and are preferably applied in strip form, with each strip measuring greater than about 2.54 centimeters (cm) in width, preferably from about 3.8 to about 6.4 cm, and most preferably, about 5.1 cm. In one such preferred embodiment, at least one (1) strip (e.g., "loop" tape) is applied across substantially the entire width of a bottom edge and a top edge of the back face of the tile, while at least one (1) strip (e.g., "hook" tape) is applied across substantially the entire width at a distance (e.g., from about 4 to about 6.5 centimeters (cm)) from a top edge of the front face of the tile. This degree of coverage of the faces of the tile and the number, width and position of the applied strips allows higher peel strength (tiles don't pull up) and more shear strength (tiles don't slide out) than applications with fewer or narrower or differently positioned strips.

Suitable adhesives for adhering these hook and loop fasteners to roofing tiles such as slate or a slate substitute have been identified by the present inventors to include acrylic, epoxy, rubber-based and urethane adhesives, and the like. The adhesive can be used alone or in combination with other adhesives either as an admixture or in layers. The adhesive can have additives such as foaming agents, fillers, thickeners, or other additives commonly added to adhesives to change or enhance their physical properties.

The adhesive may be applied by brushing, rolling, spraying, or other means to distribute an even coat of adhesive to the target surface.

Since many polymeric substrates have low surface energy, it may be necessary to raise the surface energy of the hook and loop fastener prior to the application of adhesive. Surface energy may be raised via flame treatment, surface roughening, heat, radio waves or chemical pre-treatment, and plasma or corona discharge to name some common techniques.

Opposing surfaces of the tiles may also be treated prior to the application of the adhesive.

The elongate rain diverting device of the present invention, preferably in the form of a roll (for ease of dispensing) of an ultraviolet (UV)-resistant, waterproof, polymeric material having a width ranging from about 15 to about 35 centimeters (cm) (preferably, from about 20 to about 28 cm, more preferably, from about 22 to about 26 cm), has opposing surfaces, with one surface having a first strip of hook and loop fasteners (e.g., hook portions) located at or near a lower edge thereof and an opposing surface having a second strip of complimentary portions located at or near a lower edge thereof opposite the first strip. As such, and in accordance with the inventive roofing system, the rain diverting device is releasably attached to the strip of hook and loop fastener on the front face of roofing tiles (strip A) in one row on a roof deck and to the strip on or near the lower edge of the back side of tiles (strip C) in a partially overlapping upper row.

Polymeric materials are particularly prone to UV damage upon exposure to UV light. A general loss of physical properties results, such as cracking, crazing and discoloration. In an exemplary embodiment of the present invention, the polymeric material is a UV-resistant polymeric material. In a preferred embodiment, the polymeric material is a UV-resistant, High Density Polyethylene (HDPE) polymeric material.

The inventive rain diverting device serves the dual purpose of diverting rainwater and snowmelt away from the underlying substrate (i.e., sheet material) while securing adjacent and overlapping tiles to each other. The device diverts rainwater and snowmelt away from the separation between adjacent tiles and the underlying sheet material and down onto the tiles one row or course down.

The rain diverting device may be formed from an elongated polymeric sheet material that is cut into a preferred width and adapted or modified by adhering strips of hook and look fastener at or near lower edges of opposing faces thereof and then wound onto a roll. The thickness of the rain diverting device is preferably less than or equal to about 3 millimeters (mm), more preferably from about 1 mm to about 3 mm, while the length of the device is preferably greater than or equal to the length of a row or course of tiles on a roof deck. As noted above, the width of the rain diverting device preferably ranges from about 20 cm to about 28 cm, more preferably from about 22 cm to about 26 cm. In an exemplary embodiment, the width of the strips on the elongate rain diverting device approximates the width of the strips on the tiles.

In an exemplary embodiment, the color of the rain diverting device will match or blend with the color of the roofing tiles. In a preferred embodiment, the color of the rain diverting device is either gray or black.

The strips of hook and look fasteners are adhered to the elongated polymeric sheet material by any suitable means. In one exemplary embodiment, and similar to that noted above, the strips are subjected to a surface treatment prior to application of an adhesive. Opposing surfaces of the elongated polymeric sheet material may also be treated prior to the application of the adhesive.

Suitable adhesives for adhering these strips to the elongated polymeric sheet material include polyurethane (PUR) adhesives, contact cements, epoxies, and hot melt adhesives.

Suitable rain diverting devices are available from: Primex Plastics, 1235 North F Street, Richmond, IN 47374, United States, under the trade designation PRIME VIRGIN HDPE high-density polyethylene.

The elongate rain diverting device is used in this exemplary embodiment once a row of tiles has been installed on the roof deck. The rain diverting device is then positioned over and releasably attached to the strip of hook and loop fasteners (strip A) (hook) on the front face of each tile. In one such embodiment, the rain diverting device with a back face having a strip (strip II) (loop) adhered to a lower edge thereof is positioned along the upper one-third (⅓) portion of each tile in the installed row on a roof deck, with strip II (loop) positioned over strip A (hook), which extends across the front face of the tile a distance from the top edge thereof. Strip II (loop) of the rain diverting device is applied over strip A (hook) of the tiles so that approximately one-half of the width of the device extends beyond the upper edge of each tile. In one such embodiment, the rain diverting device has a width of approximately 24 centimeters (cm) (9.5 inches), and each tile is a 30.5 cm (12 inch) square tile. The rain diverting device extends over the upper one-third (⅓) of each tile and 14 cm (5.5 inches) above each tile. When a subsequent, partially overlapping row of tiles is installed, each tile extends approximately 6.4 cm (2.5 inches) above or beyond the rain diverting device, with strip B of the tile releasably attached to the sheet material on the roof deck. Strip C of each tile would be releasably attached to strip I of the rain diverting device positioned over the underlying row of tiles.

The sheet material for adhering to a roof deck is a continuous material having an upper surface and a lower surface. The upper surface includes a hook and loop fastener and the lower surface is configured to be attached to a roof deck. The sheet material is used to seal and protect the roof deck from the environment. Suitable sheet materials are available from Velcro USA, Inc., 95 Sundial Avenue, Manchester, NH 03103, under part number h847 (ultra-low profile hook sheet material).

An insulation board or cover-board may be positioned between the sheet material and the roof deck, protecting against wind uplift and pull-out and providing a cushion against impact and a durable substrate for adhesion. The insulation board may be composed of a closed-cell polyisocyanurate foam core bonded on opposing sides to fiber-reinforced paper facers.

The sheet material may be adhered to the insulation board using any suitable adhesive or adhesive composition.

Such a sheet material/insulation board assembly is available from Carlisle SynTec Incorporated, 1285 Ritner Highway, Carlisle, PA 17013 under the trade designation RAPIDLOCK roofing system.

Such assemblies may be mechanically fastened to a clean roof deck or may be secured using an adhesive or adhesive composition. For example, two-part polyurethane adhesives, which are made up of an isocyanate blend and a polyol blend that when mixed react or crosslink to form the polyurethane adhesive, may be used. The two parts may be mixed by an applicator just prior to being applied on the surface of the roof deck. The insulation board assembly would then be laid onto and adhered to the roof deck surface.

The bond between: (a) the sheet material and roof deck, or between the sheet material, an insulation board or cover-board and the roof deck; (b) the hook and loop fasteners and each individual roofing tile; and (c) the hook and loop fasteners and the polymeric material of the elongate rain diverting device, must each exhibit a bond strength that will withstand severe environmental conditions, including high winds and hail. The term "withstand", as used herein, means that the bond does not crack, break or collapse, thereby causing catastrophic failure of bonded structures in service. In particular, the resulting bond must be vibration-resistant, withstand high uplift forces, withstand temperatures ranging from about −40° to about 200° F., and demonstrate little or no "creep" at temperatures exceeding 200° F.

With the sheet material in place on the roof deck, the tiles may be installed on the roof deck with a single lap (i.e., the upper tiles only extend over the tiles one layer down) with the tile overlap ranging from about 5 to about 12 cm, preferably from about 7 to about 11 cm, more preferably, from about 8 to about 10 cm. This results in an exposure (i.e., the non-overlapped or exposed portion of the front face of an installed tile) of from about 620 to about 697 square centimeters ($cm^2$) in the case of a 30.5 cm×30.5 cm tile, and an exposure of from about 516 to about 581 $cm^2$ for a 25.4 cm×30.5 cm tile, which are fairly large exposures as compared to, for example, traditionally laid slate. More specifically, contemplated exposures range from about 59 to about 82%, preferably from about 63 to about 78%, more preferably, from about 67 to about 75%, of the total area of the front face of the tile. Exposures for traditionally laid slate, for example, range from about 41.6% to about 46.9% of the total area of the front face of each tile.

In one exemplary embodiment, the current invention includes the following steps of use. The front and back faces of roofing slate tiles are thoroughly cleaned via water, brush, and detergent or solvent as necessary to allow gluing of the hook and loop fastener tape. The roof deck is thoroughly cleaned with water, brush, and detergent or solvent as necessary to allow proper adhesion of the glued sheet material or sheet material/insulation board assembly. A primer may be applied if required by the adhesive system.

Two pieces of hook and loop fastener tape are applied horizontally across the top and bottom of the back face of the individual slate tiles. One piece of hook and loop tape is applied horizontally across the top of the front face of the individual slate tile. Patterned slate, for example with diamond or rounded butts or lower edges, may require different orientation and coverage of hook and loop fastener material. Hip, ridge, valley, and starter slate requires different hook and loop fastener layouts.

For shipment, slates with tapes attached are stacked vertically on pallets with hook facing hook, and loop facing loop. For wind and snow prone areas, or for certain components of a roof such as the hip and ridge, both sides of the hook and loop fastener system may be treated with a two part or thermoset adhesive.

For thicker tiles with a larger airspace between the tiles and the roof deck (i.e., tiles having a thickness exceeding 9.5 mm), a Z-shaped spring may be used. The Z-shaped spring may be made from a metal or metal-like material. Due to its spring-like nature, it can be pressed or pulled but returns to its former shape once the applied force is released. The bottom face of the Z-shaped spring is adhered (e.g., via adhesive or hook and loop fastener) to the back face of the tile. A hook and loop fastener tape is adhered to the exposed top face of the Z-shaped spring. The expanding spring quality of the Z-shaped spring serves a dual purpose of supporting an overlying tile while pressing together the hook and loop fasteners of the top face of the Z-shaped spring and the upper face of the sheet material.

The Z-shaped spring may run horizontally across the width or vertically along the length of the back face of each tile. In one contemplated embodiment, the Z-shaped spring is positioned horizontally along the back face of each tile. In another contemplated embodiment, the Z-shaped spring is positioned vertically along the length of the back face of each tile, either stopping short of, or overlapping hook and loop fastener strips located on the back face at or near the uppermost and lowermost edges of each tile.

In this exemplary embodiment, individual pieces of tile are positioned next to a previously applied tile in a row on a roof deck and pressed onto both strip I of the elongate rain diverting device on the previously installed row of tiles and the hook and loop fastener on an upper surface of the underlying sheet material. The elongate rain diverting device releasably adheres adjacent tiles to one another and to overlying tiles. As noted above, the length of overlap between overlapping roof tiles ranges from about 5 to about 12 cm. The amount by which one tile overlaps an adjacent tile along its side or edge ranges from about 7.5 to about 10 cm. In wind prone areas, it may be desirable to pre-treat the sheet material and the hook and loop tapes with a slow setting epoxy or contact cement. Until the slow setting epoxy or contact cement is tacky or set up, the detachable, re-attachable nature of the hook and loop system remains available for changes during installation. The adhesive securing the hook and loop fastener to the tile is typically factory applied and cured before shipment.

A traditionally laid slate roof is typically triple overlapped with a 7.6 cm headlap. Thus a 30.5 cm long piece of traditionally laid slate would have 11.4 cm exposure, 11.4 cm of triple lapped covered or unexposed slate, and 7.6 cm of headlap. With this system, only a single 7.6 cm overlap is needed due to the presence of the elongate rain diverting device and the sheet material. This results in greater exposure, namely, 59 to 82% exposure for a 30.5 cm long piece of slate. This also results in about 45% of weight reduction versus traditionally applied slate. Further, there are additional savings in time, money, and weight due to the absence of nails. Carefully driving these nails far enough down so they are not under nailed (head of nail sticking up from face of slate) or over nailed (nail head driven down into countersink on face of slate) risks breaking the slate during installation. Typically, an accomplished traditional slate roofer can only apply 3-4 square in a day, due to the time and care involved in nailing. The current roofing system, with individual pieces of slate (each with an applied rain diverting device) just pressed together with the hook and loop system doing the attachment, is estimated to be applied 4 to 5 times faster than traditional nailed slate.

The hook and loop system takes out much of the variable quality and expensive field labor of a traditional installation method. Individual tiles may be easily pressed together in patterns which may be dictated by field conditions. Changing an individual tile because of improper color or placement is easily solved by the detachable and replaceable nature of the hook and loop fastening system.

Referring to FIGS. 1-7, the present invention includes a system and method of roofing. The present invention includes a sheet material 30 having an upper surface and a lower surface. The upper surface includes one of a hook and loop fastener 28 and the lower surface is configured to be attached to a roof deck 34. The present invention further includes a plurality of tiles 10 each having an upper edge, a lower edge, a top surface 12, and a back face 14. Hook and loop fastener 16 is applied to top surface 12 of each tile 10.

The other of the hook and loop fastener 18, 20 is attached to the back face 14 of each of the tiles 10.

The one of the hook and loop fastener 16, 28 may be either the hook or the loop portion of the hook and loop fastener. The other of the hook and loop fastener 18, 20 is complimentary and releasably connects to hook and loop fastener 16, 28. For example, the one of the hook and loop fastener 16, 28 is a loop fastener and the other of the hook and loop fastener 18, 20 is a hook fastener or vis versa.

The sheet material 30 includes an upper surface and the lower surface. An adhesive layer 32 may be disposed on the lower surface of the sheet material 30 and one of the hook and loop fasteners 28 is disposed on its upper surface. In such embodiments, the adhesive layer 32 secures the sheet material 30 to the roof deck 34. In one embodiment, the sheet material 30 may include printed or etched lines in a grid pattern to provide a reference for orientation of the individual slate tiles 10 pressed down upon it.

Each of the plurality of tiles 10 may further include a first strip 18 including the hook and loop fastener attached to the back face 14 at the upper edge, a second strip 20 including the hook and loop fastener attached to the back face 14 at the lower edge, and a third strip 16 having the hook and loop fastener attached to the top surface 12 at the upper edge. In such embodiments, the tiles 10 are releasably secured to the upper surface of the sheet material 30 by: installing a first row or starter course of tiles on the sheet material positioned on the roof deck; releasably securing the first strips 18 of the tiles 10 in subsequent rows to the upper surface of the sheet material 30; overlapping the tiles 10 with one another; and releasably securing the second strips 20 of the tiles to the third strips 16 of overlying tiles.

Each of the plurality of tiles 10 may further include a support 22 disposed in between the upper edge and the lower edge and extending from the back face 14 of the tiles 10. The support 22 includes a Z-shaped spring having an upper arm adhered to the back face of the tile 10, and a lower arm. The lower arm includes a fourth strip 24 of hook and loop fastener that releasably connects with the hook and loop fastener 28 of the sheet material 30.

Figure 8:
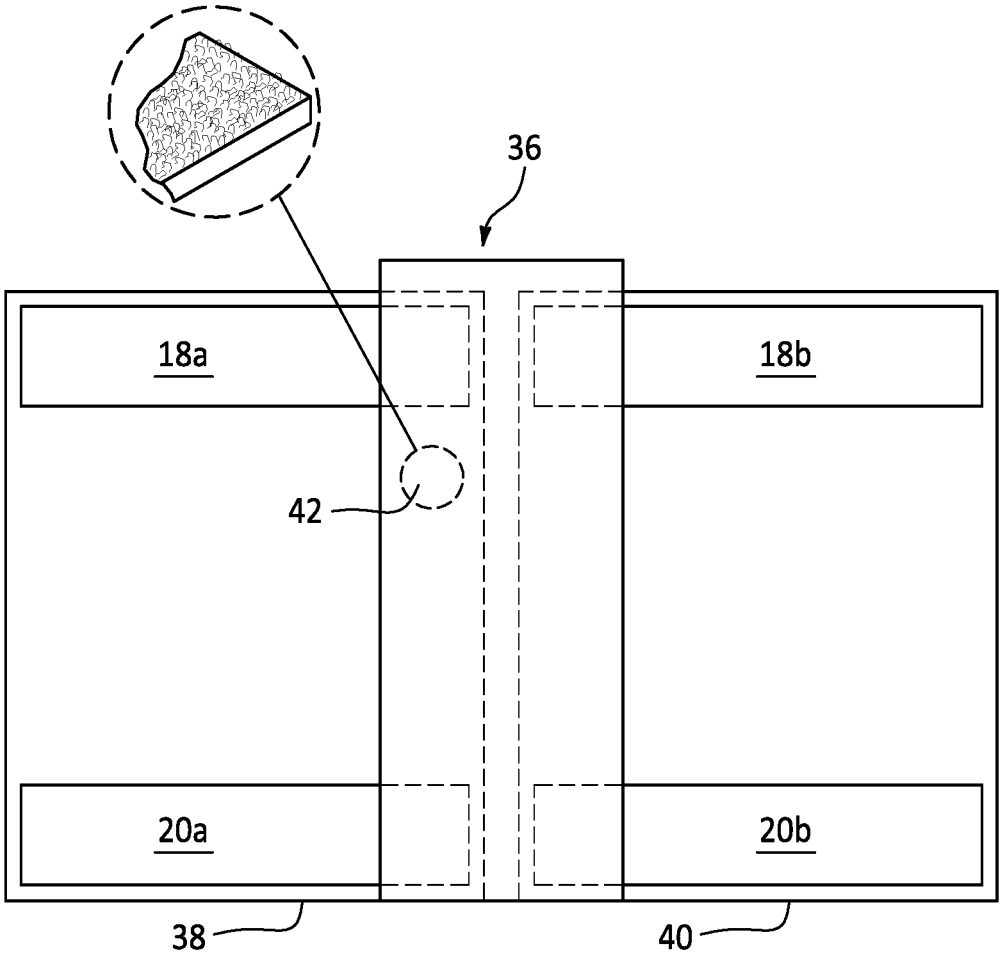
FIG. 8 is a bottom perspective view of an exemplary embodiment of the present invention in which two tiles are interlocked by a rain diverting device, an expanded view of a portion of one surface of the rain diverting device also shown in this view.

An exemplary embodiment of the rain diverting device of the present invention is shown in FIG. 8 and marked with reference number 36. The rain diverting device 36 is positioned over the hook and loop fasteners located on side-edge portions of adjacent tiles 38, 40 interlocking with portions of first strips 18*a,b* and second strips 20*a,b* on the adjacent tiles. The surface 42 of device 36, which is shown in the expanded portion of FIG. 8 as "loop" fasteners, interlocks with the sheet material (not shown). While the rain diverting device 36 is shown extending beyond the upper edges of the adjacent tiles, this is not necessary, and the device instead may be sized to match the length of the adjoining tiles. As previously stated, the use of rain diverting devices to direct rainwater and snowmelt away from an underlying sheet material and roof deck allows for single lap tiling and thus less weight on the roof deck. It also allows for shorter tiles to be used, thus saving material cost.

Figure 9:
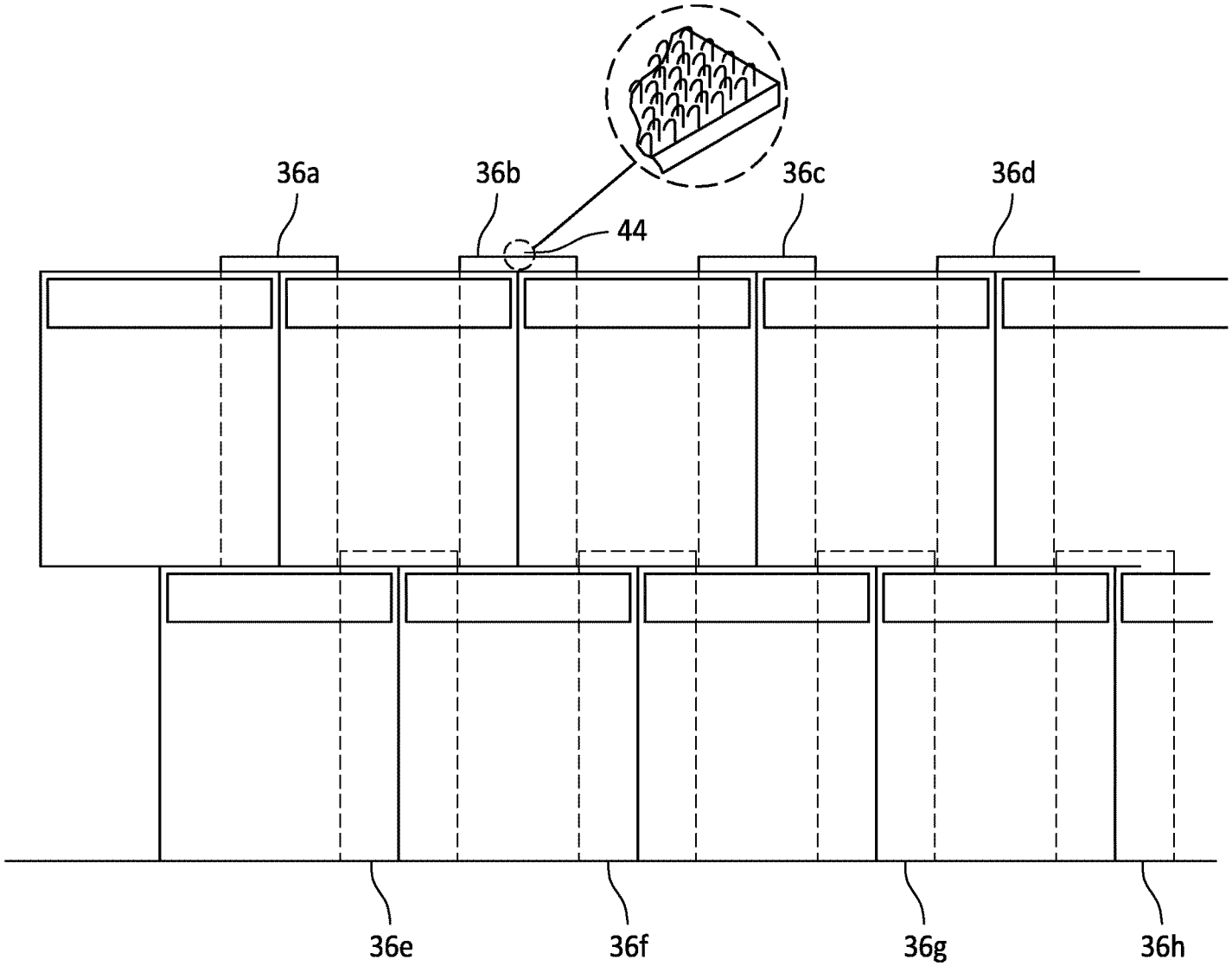
FIG. 9 is a top perspective view of an exemplary embodiment in which two rows of tiles, including those tiles shown in FIG. 8, are shown interlocked with adjoining tiles by the rain diverting devices, an expanded view of a portion of an opposing side of the rain diverting device also shown in this view.

FIG. 9 depicts two rows or courses of tiles on a roof deck, with adjacent tiles interconnected with rain diverting devices 36*a-h*. The rain diverting devices 36*a-h* serve to direct rainwater and snowmelt away from the underlying sheet material (not shown). The surface 44 of device 36*b* is shown in the expanded portion of FIG. 9 as "hook" fasteners.

Figure 10:
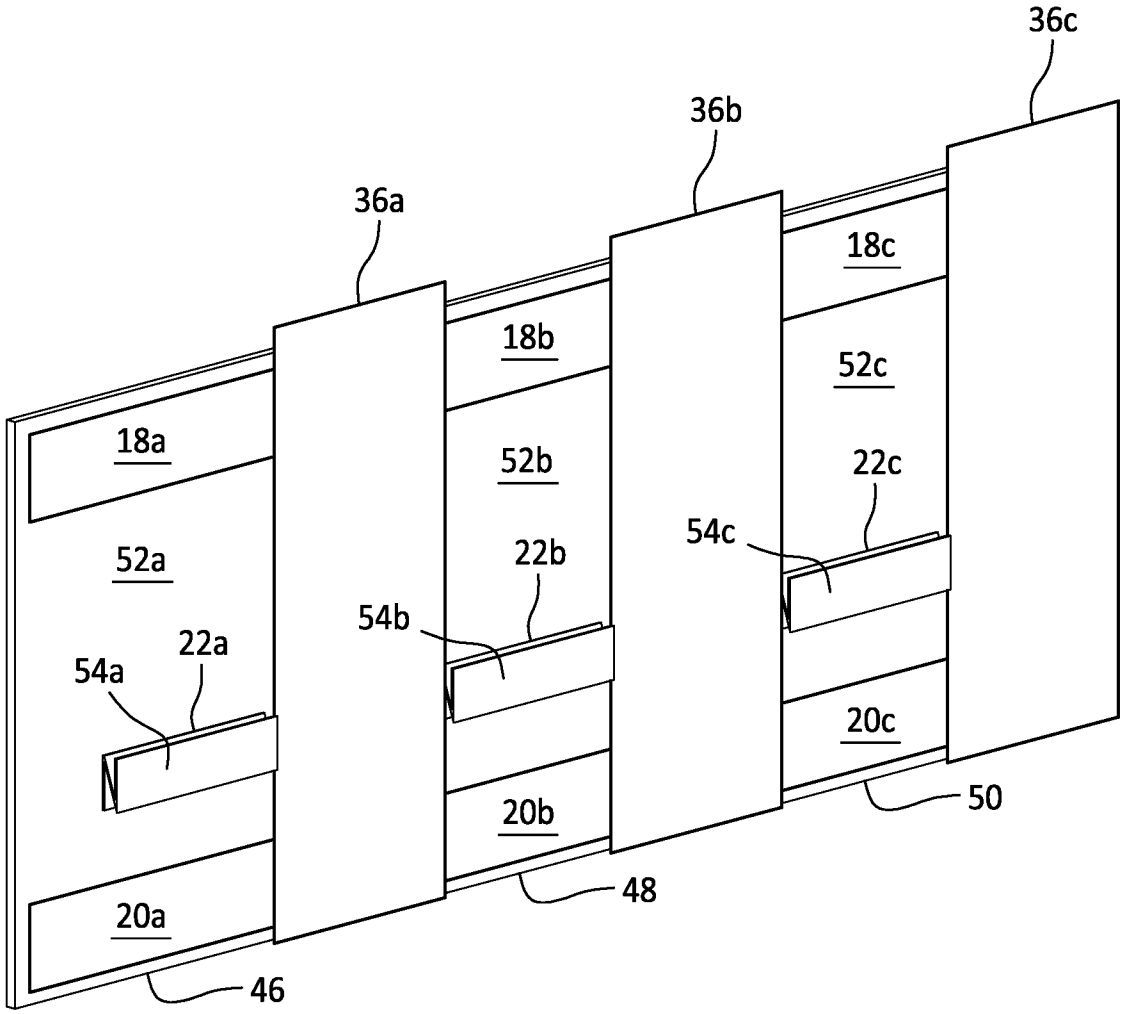
FIG. 10 is a bottom perspective view of three (3) tiles, each interconnected to adjacent tiles with the rain diverting device of the present invention and each employing a Z-shaped spring positioned horizontally across the exposed back face of each tile.

FIG. 10 depicts three adjacent tiles 46, 48, 50, which are interconnected by way of rain diverting devices 36*a-c*. Each of these tiles have the added feature of a support or Z-shaped spring 22*a-c*, positioned horizontally across the exposed back face 52*a-c* of each tile. A hook and loop fastener tape 54*a-c* is adhered to the exposed top face of the Z-shaped spring. As noted above, the Z-shaped spring serves to support each tile and to press the hook and loop fastener tape 54*a-c* on its exposed top face to the hook and loop fastener of the underlying sheet material (not shown).

Figure 11:
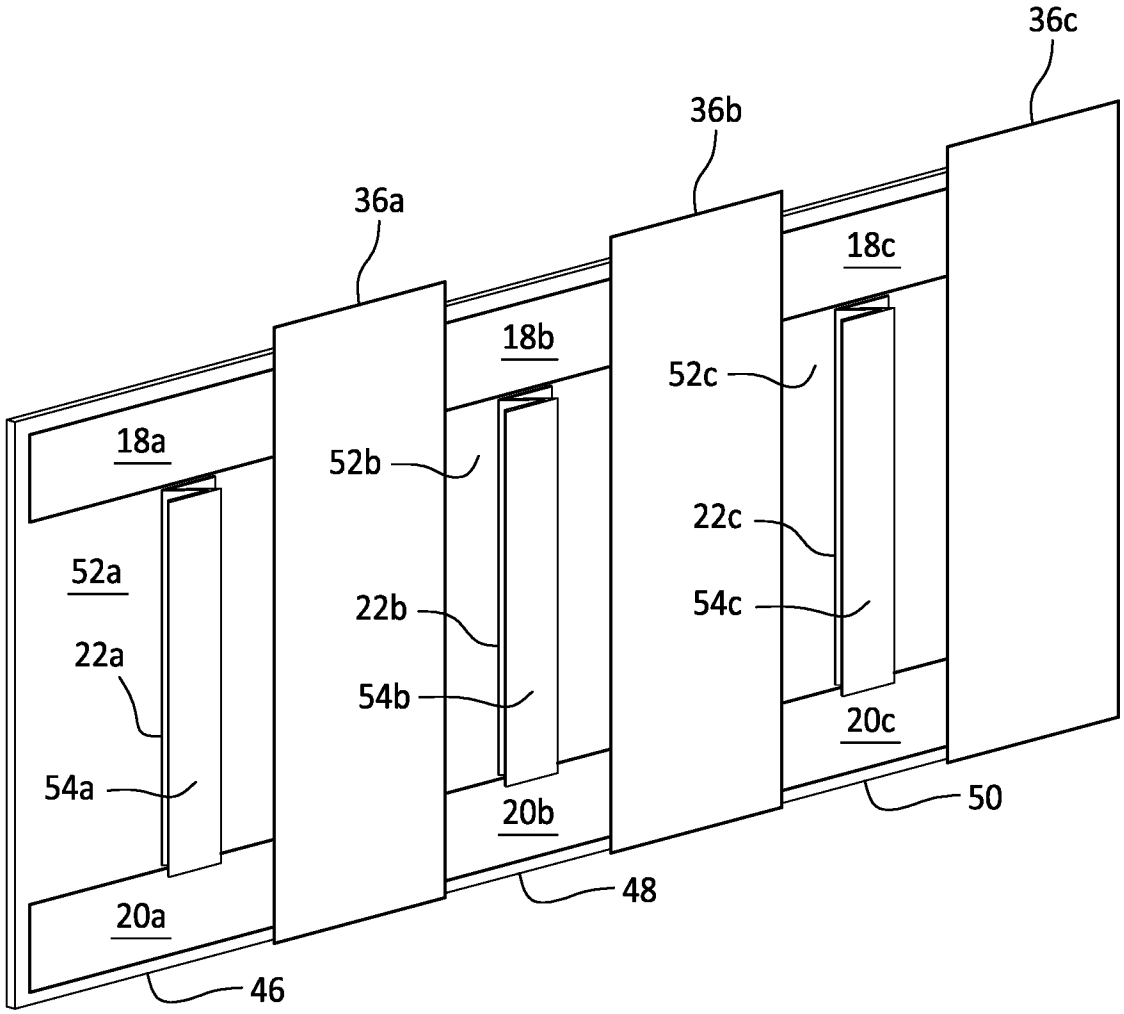
FIG. 11 is a bottom perspective view of three (3) tiles, each interconnected to adjacent tiles with the inventive rain diverting device and each employing a Z-shaped spring extending vertically along a midline on the back face of each tile just short of the first and second strips.

As noted above, and as shown in FIG. 11, the Z-shaped springs 22*a-c* may also extend vertically along a midline on the back face 52*a-c* of each tile, just short of the first strips 18*a,b,c* and the second strips 20*a,b,c*. In this embodiment, the Z-shaped spring may be adhered to the exposed back face 52*a-c* of each tile using, for example, an adhesive.

Figure 12:
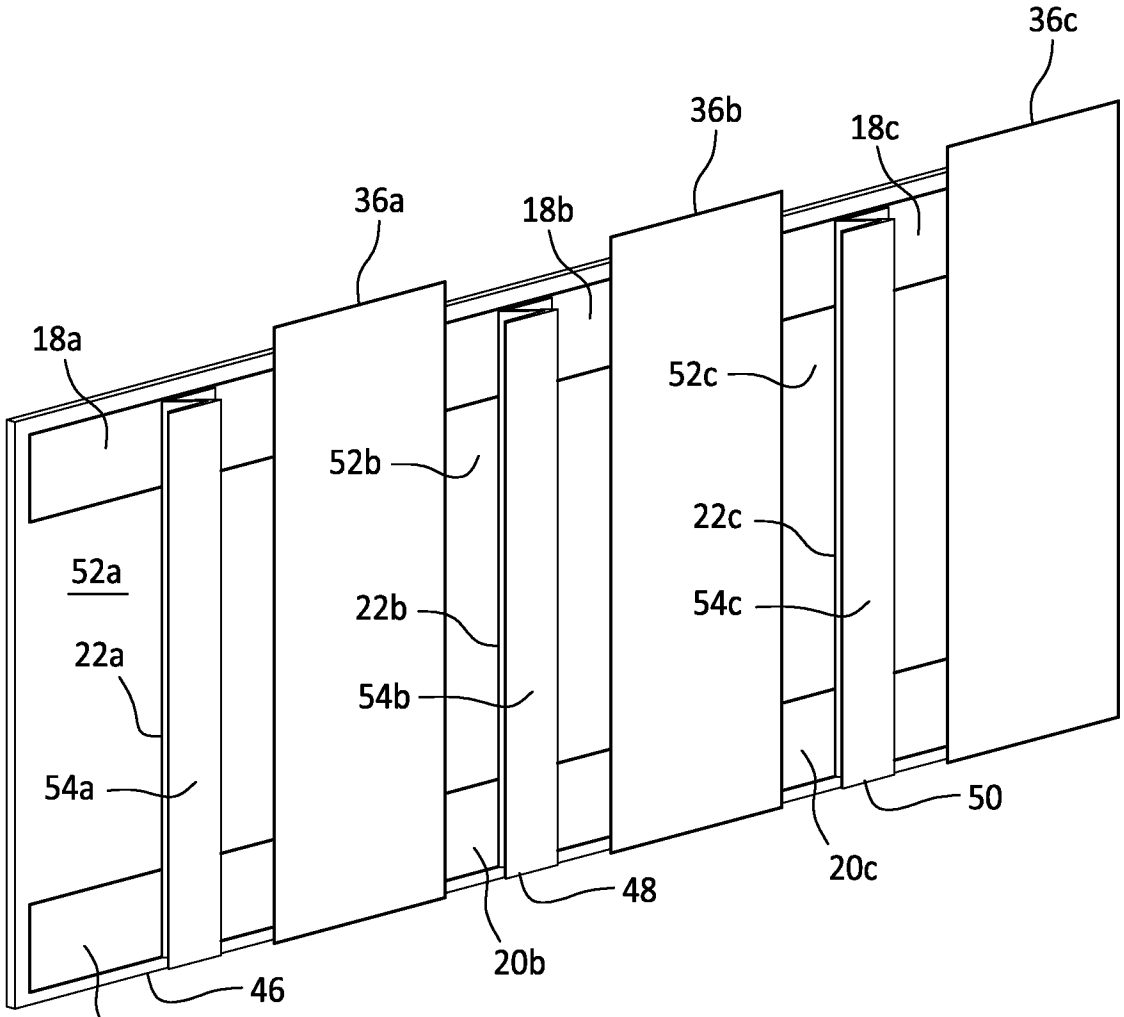
FIG. 12 is a bottom perspective view of three (3) tiles, each interconnected to adjacent tiles with the inventive rain diverting device and each employing a Z-shaped spring extending vertically along a midline on the back face of each tile and extending over (and releasably attached to) the first and second strips.

In FIG. 12, the Z-shaped springs 22*a-c* are shown extending vertically along a midline on the back face 52*a-c* of each tile and over the first strip 18*a,b,c* and the second strip 20*a,b,c* of each tile. In this embodiment, a hook and loop fastener tape is adhered to both the top and bottom faces of each Z-shaped spring, the bottom face of each Z-shaped spring being releasably engaged with the first and second strips.

Figure 13:
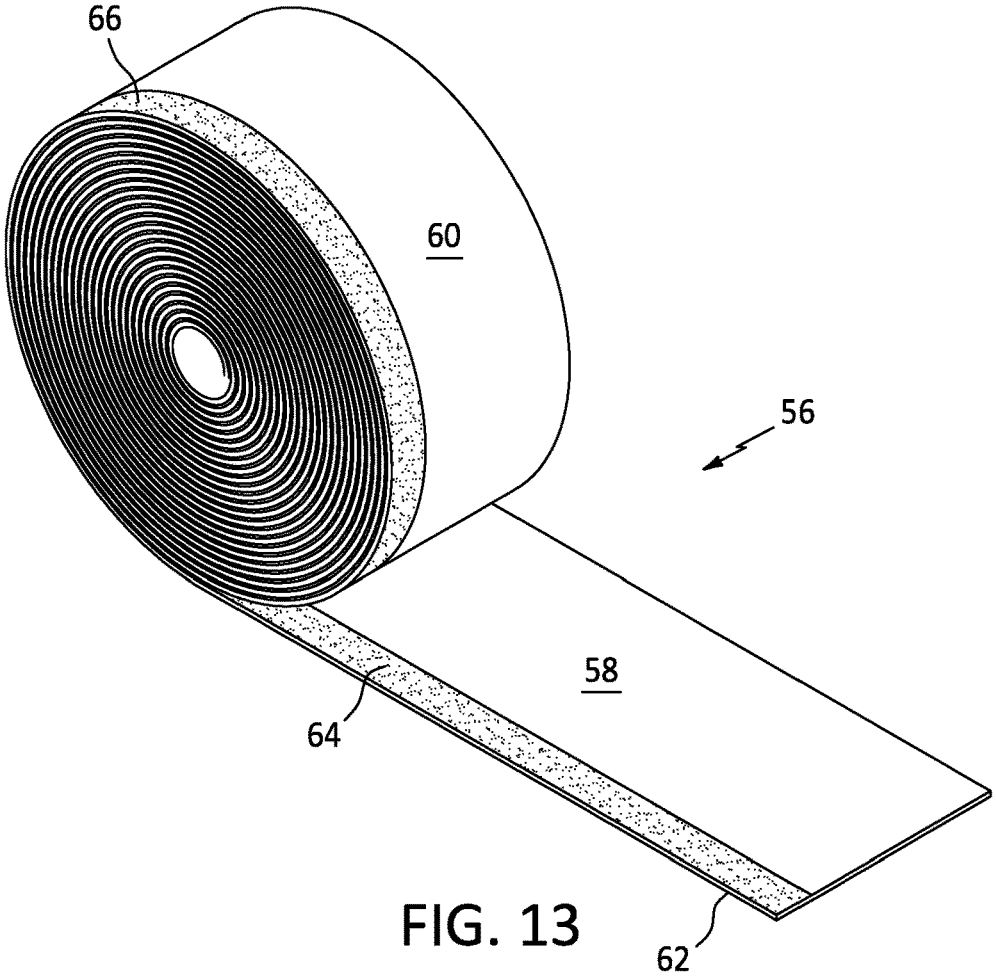
FIG. 13 is a side perspective view of an embodiment of the elongate rain diverting device of the present invention in the form of a roll for dispensing the device onto a roof deck.

A further exemplary embodiment of the rain diverting device of the present invention in the form of a roll of an elongate rain diverting device is shown in FIG. 13 and marked with reference number 56. The ends of each roll of elongate rain diverting device 56 may be lapped, if necessary, to span the entire width of the roof. A 7.6 cm (3 inch) lap is typical in such situations. The elongate rain diverting device 56 has a front and a back face 58, 60, each with a corresponding lower edge 62. Two strips of hook and loop fasteners 64 (strip I), 66 (strip II), each having a width that preferably approximates the width of the strips adhered to each tile, are adhered along the lower edge 62 of the front and back faces 58, 60 of device 56.

Figure 14:
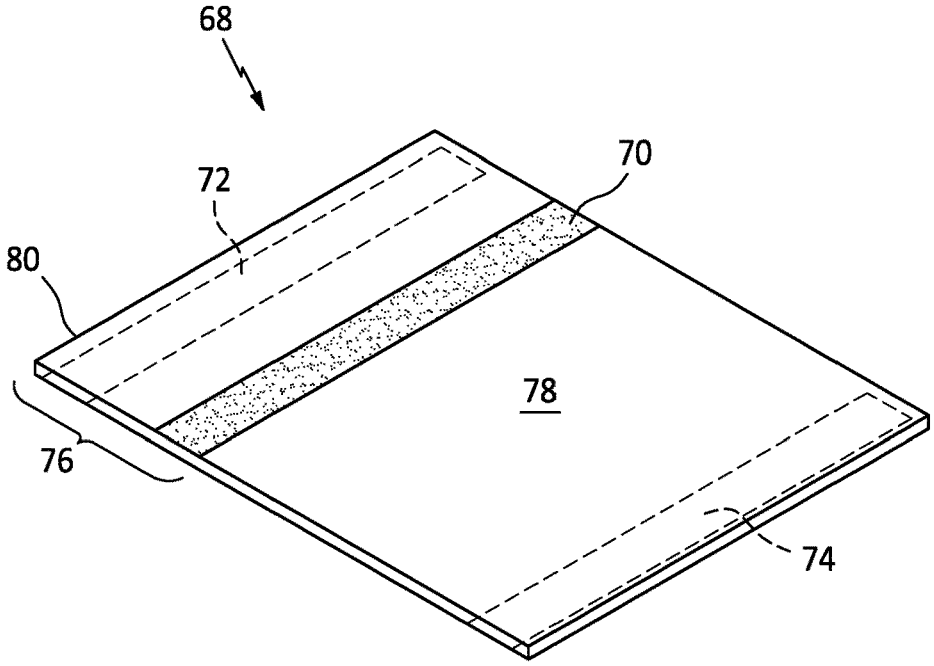
FIG. 14 is a top perspective view of an embodiment of a tile in accordance with one embodiment of the present invention.

In FIG. 14, a further exemplary embodiment of the tile of the present invention is shown and marked with reference number 68. Tile 68 has three strips 70 (strip A), 72 (strip B), 74 (strip C), each having a width and hook and loop fasteners on a surface thereof. The strips are adhered to and extend across the width of the tile. Strip 70 (strip A) is adhered to an upper portion 76 of a front face 78 of the tile at a distance from an upper edge 80. Strips 72 (strip B) and 74 (strip C) are adhered to an upper and to a lower portion of the back face of the tile near upper and lower edges thereof.

Figure 15:
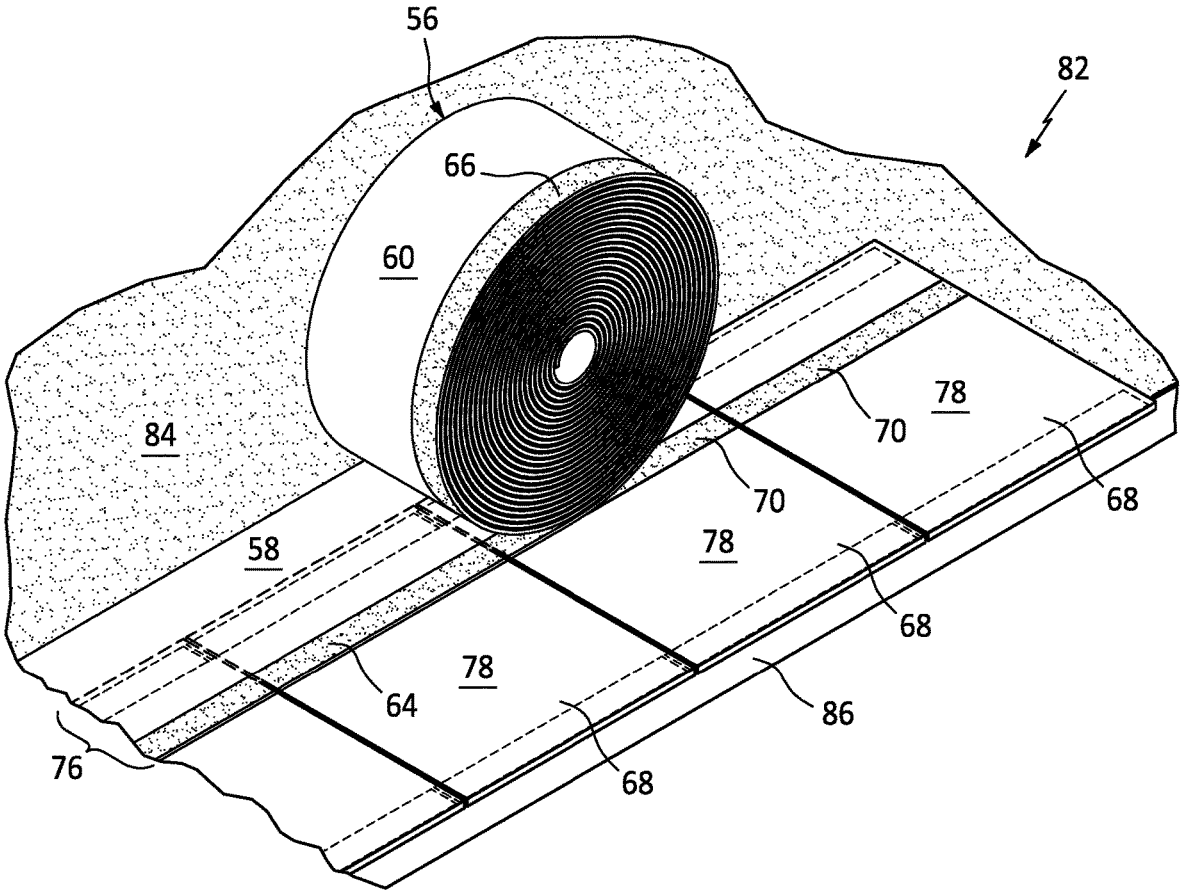
FIG. 15 is a top perspective view of an exemplary embodiment of the present invention in which a first row of tiles is shown installed on a roof deck, with the roll of rain diverting device shown in FIG. 13 being dispensed onto and releasably attached to the top portion of each tile in this row.

In FIG. 15, a first exterior row of tiles 68 is shown installed on a roof deck 82, with strip 66 (strip II (loop)) of rain diverting device 56 shown being dispensed onto and releasably attached to strip 70 (strip A (hook)) of each tile 68 in this first row. The rain diverting device 56 overlies the upper portion 76 of each tile, extending above each tile onto the underlying sheet material 84 on the roof deck. As previously mentioned, this first exterior row of tiles is positioned over the starter row (including flashing or drip edge 84) assembled on or near the edge of the roof deck 82.

Figure 16:
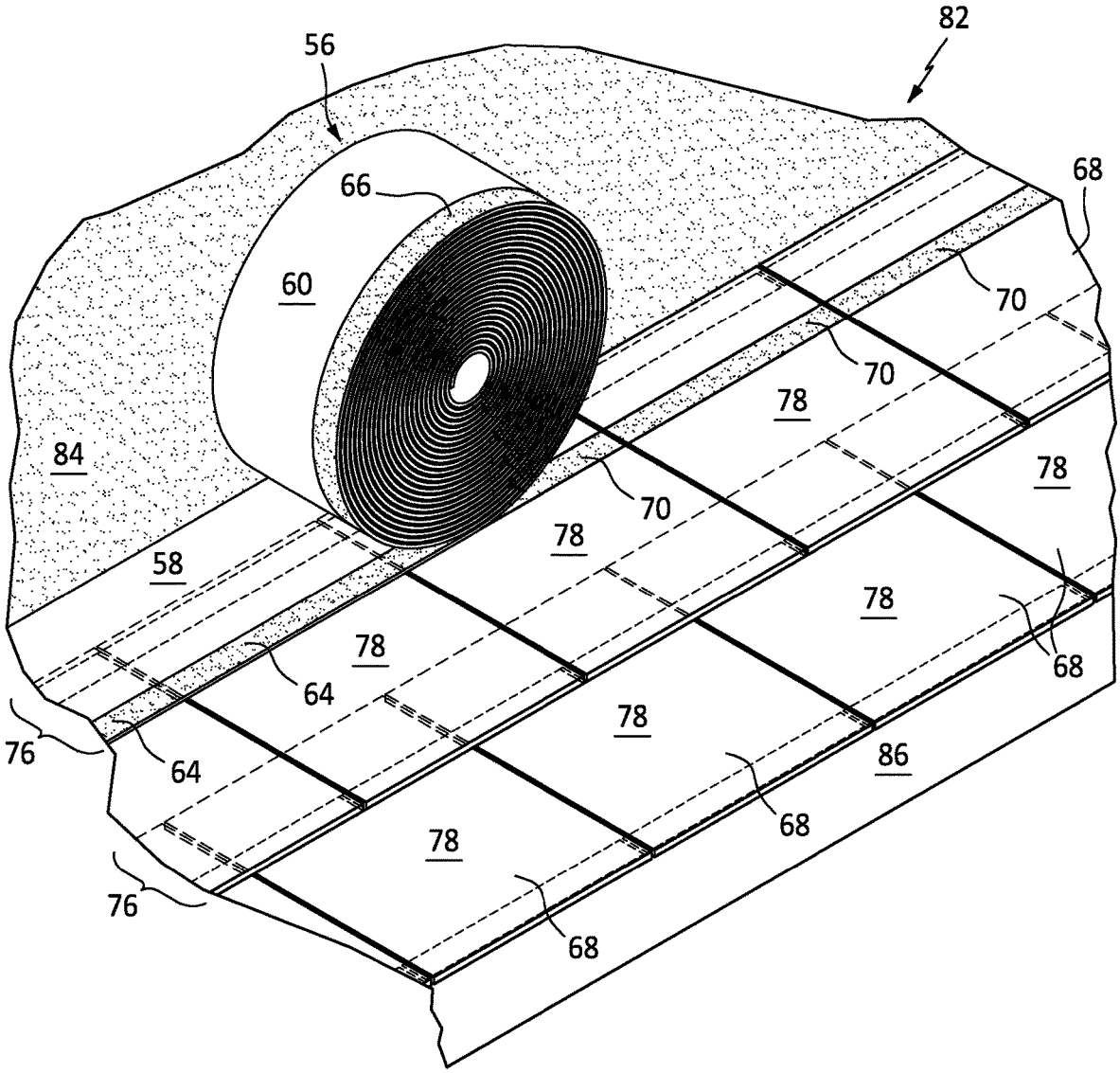
FIG. 16 is a top perspective view of an exemplary embodiment in which two rows of tiles are shown installed on a roof deck, with the roll of rain diverting device shown in FIG. 13 being dispensed over and releasably attached to the top portion of each tile in the second row.

In FIG. 16, a second exterior row of tiles 68 is shown installed on roof deck 82. The tiles in the second row partially overlap the tiles in the first row, with strip 72 (strip B) positioned over and releasably attached to the sheet material 84 on the roof deck 82, and with strip 74 (strip C) of the tiles in the second, overlapping row positioned over and releasably attached to strip 70 (strip A) of the tiles in the first, underlying row. The rain diverting device 56 overlies the upper portion 76 of each tile in the second row, extending above each tile onto the underlying sheet material 84 on the roof deck 82. This process is then repeated until the roof has been completely tiled.

As mentioned above, the inventive rain diverting device serves to divert rainwater and snowmelt away from the underlying substrate (i.e., sheet material). In particular, the device diverts rainwater and snowmelt away from separations between adjacent tiles and the underlying sheet material and down onto the tiles one row or course down.

It should be understood, of course, that the foregoing relates to exemplary embodiments of the invention and that modifications may be made without departing from the spirit and scope of the invention as set forth in the following claims.

What is claimed is:

1. A system of roofing, which comprises:

a sheet material for adhering to a roof deck, which has an upper surface and a lower surface, the upper surface including a hook and loop fastener;

a plurality of roofing tiles each having a width and a front and back face;

a plurality of strips having a width, with hook and loop fasteners on a surface thereof, which are adhered to and extend across at least a portion of the width of each roofing tile, the plurality of strips comprising a strip A on an upper portion of the front face of each roofing tile at a distance from an upper edge thereof, and strips B and C on an upper and on a lower portion of the back face near upper and lower edges thereof;

a plurality of elongate rain diverting devices, each having a front and a back face with a corresponding lower edge, wherein for each elongate rain diverting device, a strip I of hook and loop fasteners, having a width is adhered along the lower edge of the front face of the elongate rain diverting device, and a strip II of hook and loop fasteners, having a width is adhered along the lower edge of the back face of the elongate rain diverting device, wherein once roofing tiles of the plurality of rooting tiles are arranged in a course or row on the roof deck and releasably attached to the sheet material by way of the strip B, an elongate rain diverting device of the plurality of elongate rain diverting devices is positioned on the upper portion of the front face of each roofing tile, extending above each roofing tile and onto the sheet material, and across the roof deck, and is releasably attached to each roofing tile by way of the strip II of the elongate rain diverting device being releasably attached to the strip A of each roofing tile, wherein as each subsequent row of roofing tiles of the plurality of roofing tiles is arranged on the roof deck, partially overlapping an underlying row with a partially overlying elongate rain diverting device of the plurality of elongate rain diverting devices, each roofing tile in the subsequent row is releasably attached to the elongate rain diverting device by way of the strip C of the roofing tile being releasably attached to the strip I of the elongate rain diverting device and is releasably attached to the sheet material by way of the strip B of the roofing tile being releasably attached to the hook and loop fastener on the upper surface of the sheet material.

2. The system of roofing of claim 1, wherein the width of the strips adhered to the elongate rain diverting device approximates the width of the strips adhered to each tile.

3. The system of roofing of claim 1, wherein the elongate rain diverting device is made from an ultraviolet-resistant, waterproof, polymeric material.

4. The system of roofing of claim 3, wherein the polymeric material is a high-density polyethylene polymeric material.

5. The system of roofing of claim 1, wherein the rain diverting device is a rolled sheet-like material having a thickness of less than or equal to about 3 millimeters and a width ranging from about 15 to about 35 centimeters, which extends across all or at least a major portion of the width of the roof deck.

6. The system of roofing of claim 1, wherein the roofing tiles are selected from the group of slabs or shingles made from asphalt, wood, cement, fiber-cement mixtures, concrete, clay or ceramic material, slate or slate substitute, rubber slate, and other hardwearing materials and metal.

7. The system of roofing of claim 6, wherein the roofing tiles are selected from the group of slate, slate substitute and rubber slate tiles.

8. The system of roofing of claim 1, wherein the upper surface of the sheet material contains a grid pattern for providing a reference for placement of the tiles pressed down upon it.

9. The system of roofing of claim 1, wherein the lower surface of the sheet material is adhered to an insulation board, which is adhered to the roof deck.

10. The system of roofing of claim 1, wherein each strip has a width greater than about 2.54 centimeters.

11. The system of roofing of claim 10, wherein each strip has a width ranging from about 3.8 to about 6.4 centimeters.

12. The system of roofing of claim 1, wherein each strip has a thickness of less than or equal to about 3 millimeters.

13. The system of roofing of claim 1, wherein the hook and loop fasteners on the upper surface of the sheet material are hook fasteners.

14. The system of roofing of claim 13, wherein the strip A adhered to the front face of each roofing tile are hook fasteners and the strips B and C adhered to the back face of each roofing tile are loop fasteners.

15. The system of roofing of claim 14, wherein the strip I adhered along the lower edge of the front face of the elongate rain diverting device are hook fasteners, and the strip II adhered along the lower edge of the back face of the elongate rain diverting device are loop fasteners.

16. The system of roofing of claim 1, wherein the roofing tiles are single lapped with exposed portions of the front face of each tile ranging from about 59 to about 82% of the total area of the front face.

17. A method of installing tiles on a roof, which comprises:

providing a sheet material having an upper surface and a lower surface, the upper surface including a hook and loop fastener; securing the lower surface of the sheet material to a roof deck;

providing a plurality of roofing tiles, each roofing tile having a width and a front and back face, wherein strips of hook and loop fasteners are adhered to and extend across at least a portion of the width of each roofing tile, the strips comprising a strip A on an upper portion of the front face at a distance from an upper edge thereof, and strips B and C on an upper and on a lower portion of the back face near upper and lower edges thereof;

providing a plurality of elongate rain diverting devices, each having a front face and a back face with a lower edge, wherein for each elongate rain diverting device, a strip I of hook and loop fasteners, having a width is adhered along the lower edge of the front face of the elongate rain diverting device of the plurality of elongate rain diverting devices, and a strip II of hook and loop fasteners, having a width is adhered along the lower edge of the back face of the elongate rain diverting device, wherein, once roofing tiles of the plurality of roofing tiles are arranged in a course or row on the roof deck and adhered to the sheet material by way of the strip B of each roofing tile, positioning an elongate rain diverting device of the plurality of elongate rain diverting devices on the upper portion of the front face of each roofing tile, extending above each roofing tile onto the sheet material, adhering the elongate rain diverting device to each roofing tile by way of the strip II of the elongate rain diverting device being releasably attached to the strip A of each roofing tile, wherein as each subsequent row of tiles is arranged on the roof deck, partially overlapping an underlying row with an overlying elongate rain diverting device of the plurality of elongate rain diverting devices, releasably attaching each roofing tile to an underlying elongate rain diverting device of the plurality of elongate rain diverting devices by way of the strip C of each roofing tile being releasably attached to the strip I of the underlying elongate rain diverting device, releasably attaching each roofing tile to the sheet material by way of strip B of each roofing tile being releasably attached to the hook and loop fastener on the upper surface of the sheet material, and positioning another elongate rain diverting device of the plurality of elongate rain diverting devices, on the upper portion of the front face of each roofing tile in the subsequent row, extending above each roofing tile onto the sheet material, and across the roof deck, and adhering the elongate rain diverting device to each roofing tile by way of the strip II of the elongate rain diverting device being releasably attached to the strip A of each roofing tile.

18. A method of using a plurality of elongate rain diverting devices to direct rainwater and snowmelt away from an underlying sheet material on a roof deck, each elongate rain diverting device having strips of hook and loop fasteners adhered to lower edges of opposing faces, wherein for each row of tiles installed on the roof deck, the method comprises: positioning and releasably attaching the elongate rain diverting device to upper portions of exposed faces of the tiles in the row prior to installation of a subsequent, partially overlying row, the elongate rain diverting device extending above each tile onto the sheet material and across the roof deck, wherein each elongate rain diverting device serves to divert rainwater and snowmelt away from separations between adjacent tiles and the underlying sheet material.

* * * * *